United States Patent [19]

Eberle

[11] 4,381,056

[45] Apr. 26, 1983

[54] CONVEYOR APPARATUS, ESPECIALLY FOR PRINTED PRODUCTS

[75] Inventor: Jürg Eberle, Hinwil, Switzerland

[73] Assignee: Ferag AG, Hinwil, Switzerland

[21] Appl. No.: 225,420

[22] Filed: Jan. 15, 1981

[30] Foreign Application Priority Data

Feb. 8, 1980 [CH] Switzerland ..... 1020/80

[51] Int. Cl.³ ..... B65G 47/86

[52] U.S. Cl. ..... 198/696; 271/204; 294/104

[58] Field of Search ..... 198/479, 486, 653, 695, 198/696; 414/740, 744 A, 753; 271/204–206, 268, 277, 82, 85; 294/99 R, 104

[56] References Cited

U.S. PATENT DOCUMENTS

| | | | |
|---|---|---|---|
| 2,025,481 | 12/1935 | Stussi | 271/204 |
| 3,955,667 | 5/1976 | Muller et al. | 294/104 |
| 4,039,182 | 8/1977 | Reist et al. | 271/204 |
| 4,149,623 | 4/1979 | Nelson | 198/479 |
| 4,320,894 | 3/1982 | Reist et al. | 271/204 |

*Primary Examiner*—Joseph E. Valenza
*Attorney, Agent, or Firm*—Werner W. Kleeman

[57] ABSTRACT

An article conveyor apparatus is disclosed wherein the gripper clamps possess a movable clamping tongue and a fixed clamping tongue which forms part of a housing. The movable clamping tongue is formed of one-piece with a spiral spring. The latter is wound about a hollow shaft rotatably mounted in the housing. The hollow shaft is rigidly connected for rotation with an arm or lever carrying at its end a roller. A part of the hollow shaft is constructed as a blocking wheel of a blocking mechanism. This blocking wheel is provided with a gap into which engages, in the latching position, the one end of a blocking pawl pivotably mounted in the housing. Upon travel of the roller upon a bracket or cam or the like the hollow shaft is rotated in a predetermined direction, whereby the movable clamping tongue is moved towards the other clamping tongue. If both clamping tongues are brought together then during further rotation of the hollow shaft the spiral spring is tensioned. The tensioned spiral spring exerts a closing force upon the movable clamping tongue. Retrorotation of the hollow shaft is prevented by the blocking pawl which has latched into the gap. To open the gripper clamp the blocking pawl of the blocking arrangement is released by depressing upon a part protruding past the housing. The now relaxed spiral spring rotates the hollow shaft in another predetermined direction, so that the movable clamping tongue is raised from the stationary clamping tongue. The spiral spring therefore serves both as a closing spring and also as an opening spring for the clamping tongues and also as a holder spring for the blocking mechanism.

12 Claims, 6 Drawing Figures

CONVEYOR APPARATUS, ESPECIALLY FOR PRINTED PRODUCTS

BACKGROUND OF THE INVENTION

The present invention relates to a new and improved construction of a conveyor apparatus, especially for printed products.

Generally speaking, the article conveying apparatus of the present development is of the type comprising gripper clamps anchored in spaced relationship from one another at a revolving traction or tension element. The one movable clamp portion is brought into a closed position by means of an actuation element which coacts with a stationary control device and it is retained in such closed position by a releasable locking device.

With such type prior art conveyor apparatus the movable clamp portion is attached to a guide bolt which is displaceably guided in its axial direction within the gripper housing against the action of a compression or pressure spring. Significant in this regard is German Patent Publication No. 2,519,561 and U.S. Pat. No. 3,955,667. In the closed position the guide bolt, and thus, the movable clamp portion is locked by means of a releasable clamp lock which bears against the guide bolt and arrests the same. The closed position of the movable clamp or clamping portion is not exactly defined and depends upon the thickness of the seized product. To render possible a faultless grasping of products of any random thickness, both of the clamp portions must possess an appropriately long length. This results in the lever arm of the closing force acting upon the guide bolt becoming correspondingly longer. This leads, in turn, to the fact that the guide bolt can cant, something which impairs both the proper closing operation and also an immediate opening of the gripper. A faultless clamping of the seized products and a faultless opening at the desired site therefore is not ensured for with such construction. Additionally, the closed position which is governed by the thickness of the seized product does not satisfactorily take into account the requirement that thicker products, because of their usually greater weight, must be retained with a larger clamping force than thin products.

SUMMARY OF THE INVENTION

Therefore with the foregoing in mind it is a primary object of the present invention to overcome the aforementioned drawbacks and limitations of the prior art constructions.

Another and more specific object of the present invention aims at providing a new and improved construction of an article conveyor apparatus of the previously mentioned type which allows for a faultless seizing and retention of articles, such as typically for instance by way of example and not limitation printed products, of different thickness and equally enables an instantaneous release of such seized articles.

Yet a further significant object of the present invention aims at providing a new and improved construction of an article conveyor apparatus which is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the conveyor apparatus of the present development is manifested by the features that the locking device is constructed as a latching device having a defined latching position. The actuation element is operatively coupled with the latchable element of the latching device and such actuation element is connected with the aforementioned movable clamp or clamping portion by means of a spring element which is tensioned when the gripper clamp is closed.

The spring element which is arranged between the actuation element causing closing of the gripper clamp and the movable clamp portion is tensioned during the course of the closing operation and exerts upon such clamp portion a closing force. Additionally, this tensioned spring element ensures for a locking of the latching device. The spring element therefore serves both as a closing spring for the gripper clamp and also as a holder spring for the latching device. Moreover, the spring element also assumes the function of an opening spring. If, namely, the latching device is released, then the movable clamp portion is raised from the other stationary or fixed clamp portion by the action of the relaxing spring element, so that there is possible an immediate release of the seized article or the like. Since the latching position is exactly defined, the spring element is more intensely tensioned in the presence of thick articles than in the case of thin articles, leading to a desired greater clamping force when handling thick articles.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 6 is a sectional view taken substantially along the line VI—VI of FIG. 4.

DETAILED DESCRIPTION OF THE PREFERRED EMBODIMENTS

Figure 1:
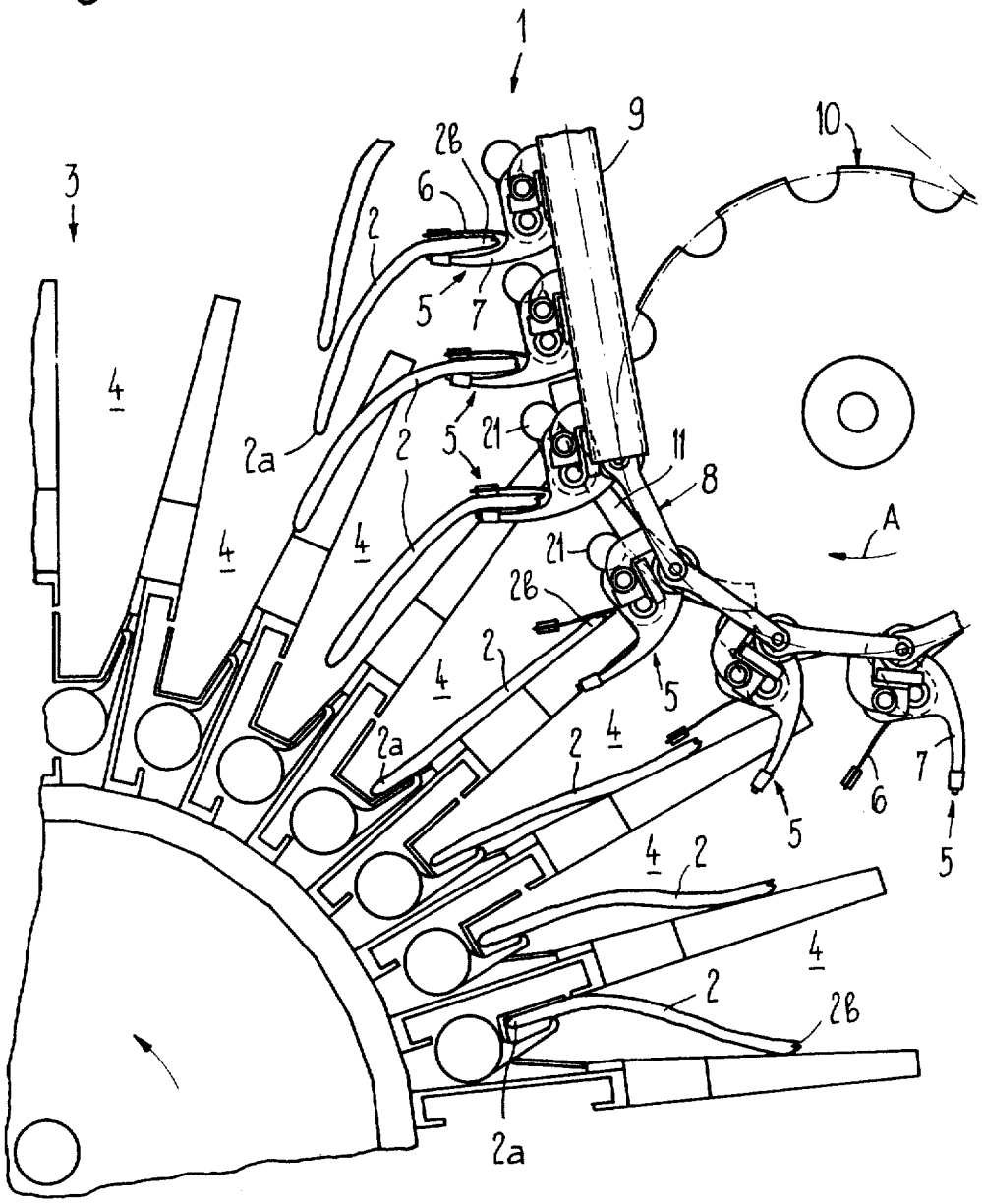
FIG. 1 is a schematic side view of part of a conveyor apparatus according to the invention shown at the article transfer or take-up region.

Describing now the drawings, in FIG. 1 there is illustrated part of the conveyor device 1 at the transfer or take-over section for the articles being handled, here assumed to be printed products 2. These printed products 2 lie in outwardly open, radial compartments 4 of an only partially illustrated but known revolving cell wheel 3. The construction and mode of operation of such cell wheel, as stated, is known and has been described in detail for instance in German Pat. No. 2,447,336 and the corresponding U.S. Pat. No. 3,951,399 and German Pat. No. 2,604,104 and the corresponding U.S. Pat. No. 4,058,202, to which reference may be readily had and the disclosure of which is incorporated herein by reference. The printed products 2 bear by means of their fold 2a at the base or floor of the compartments 4. The conveyor device 1 will be seen to contain grippers or gripper clamps 5 for seizing and transporting the printed products 2. These grippers 5 each contain a movable gripper clamp tongue 6 and a counter-gripper clamp tongue 7 coacting with the movable clamp or clamping tongue 6. The construction of such grippers or gripper clamps 5 will be described in greater detail in conjunction with FIGS. 2 to 6. These gripper clamps 5 are attached in spaced relationship from one another at a suitable revolving traction or tension element 8 which, for instance, can be constructed as a ball-and-socket joint-link chain, such as has been described in British Pat. No. 1,549,383 and the corresponding German Patent Publication No. 2,629,528 as well as the copending United States application Ser. No. 867,027, filed Jan. 5, 1978, now U.S. Pat. No. 4,294,345, granted Oct. 13, 1981, to which reference may be likewise readily had and the disclosure of which is equally incorporated herein by reference. This traction element 8 travels in a closed guide channel 9, as best seen by referring to FIG. 3, which is provided at its underside with a longitudinal or lengthwise extending slot 9a. As particularly well seen by referring to FIG. 1, this traction element 8 is trained about a deflection wheel 10 or the like which rotates in the direction of the arrow A, i.e. in the transport direction. In order to close the gripper clamps 5 there is provided a stationary bracket or cam arrangement 11 or equivalent structure.

Based upon the illustration of FIGS. 2 to 6 there will now be explained in detail the construction of the gripper clamps 5 and their attachment at the traction element 8.

Figure 2:
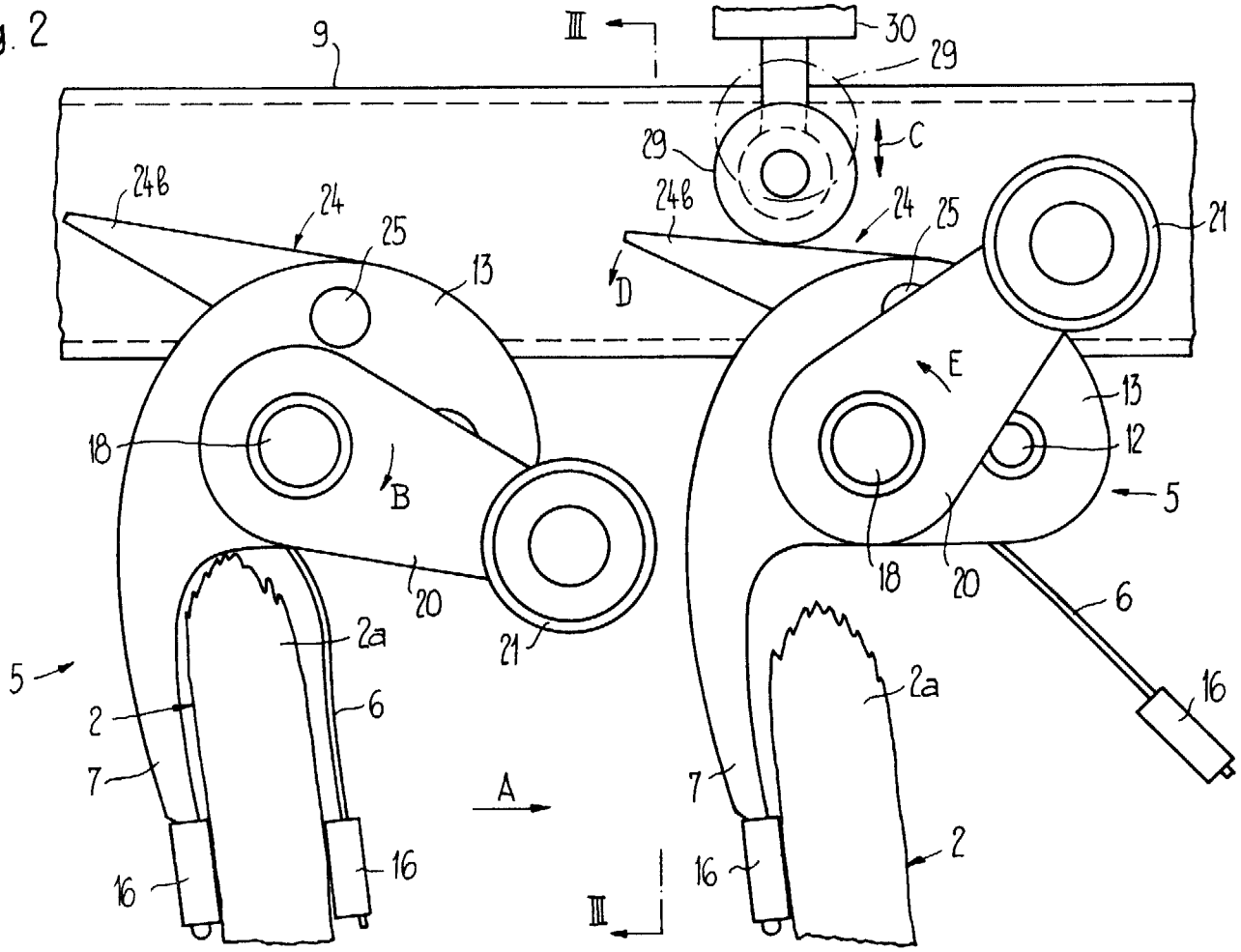
FIG. 2 is a schematic side view of part of the conveyor apparatus of FIG. 1 shown at the outfeed or delivery region.
Figure 3:
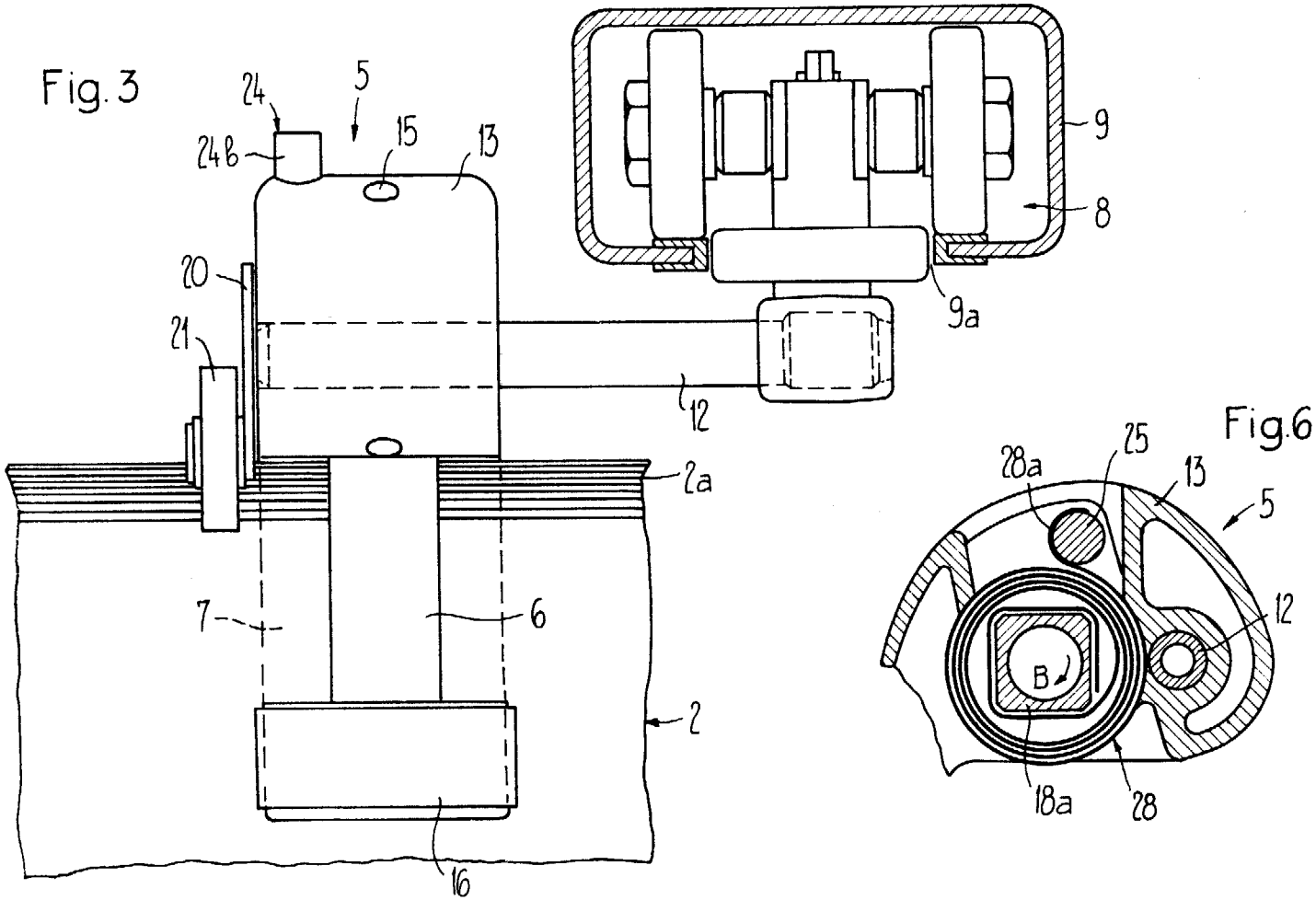
FIG. 3 is a sectional view taken substantially along the line III—III of FIG. 2.

As best seen by referring to FIG. 3, there are secured at the traction element 8 at a relatively uniform spacing from one another arms or arm members 12 which extend towards the side, the gripper clamps or grippers 5 being seated upon such arm members. These arm members 12 engage into an opening provided in a gripper housing 13. By means of a securing pin 14 which pierces the related arm 12, and which securing pin 14 is accommodated in a throughpass opening 15 in the gripper housing 13, the grippers or gripper clamps 5 are retained at the related arm or arm member 12, as best seen by referring to FIG. 5. As particularly well recognised by inspecting FIGS. 2 and 5, the stationary or fixed clamp tongue 7 is constructed to constitute part of the housing 13. At its ends both of the clamp tongues 6 and 7 are provided with a rubber bellows 16 or the like, which, on the one hand, protects the seized printed product 2 or other engaged article against damage and, on the other hand, increases the static friction between the clamping tongues 6, 7 and the printed product 2.

The movable clamping tongue 6 consists of a spring steel and is formed of one-piece with a spiral spring 17 merging at its rear end. This spiral spring 17 is wound about a hollow shaft 18 which is rotatably mounted in the housing 13. This hollow shaft 18 possesses a square or four-cornered portion 18a (FIG. 5) over which there is guided the spiral spring 17. In this way there is obtained a good connection between the shaft 18 and the spiral spring 17. The hollow shaft 18 which extends through the housing 13 is secured at one end by means of a securing ring 19 or equivalent structure and is rigidly connected at its other opposite end with a lever 20, as best seen by referring to FIG. 4. This lever or lever member 20 carries at its free end a roll or roller 21, as particularly evident by inspecting FIG. 2.

Figure 5:
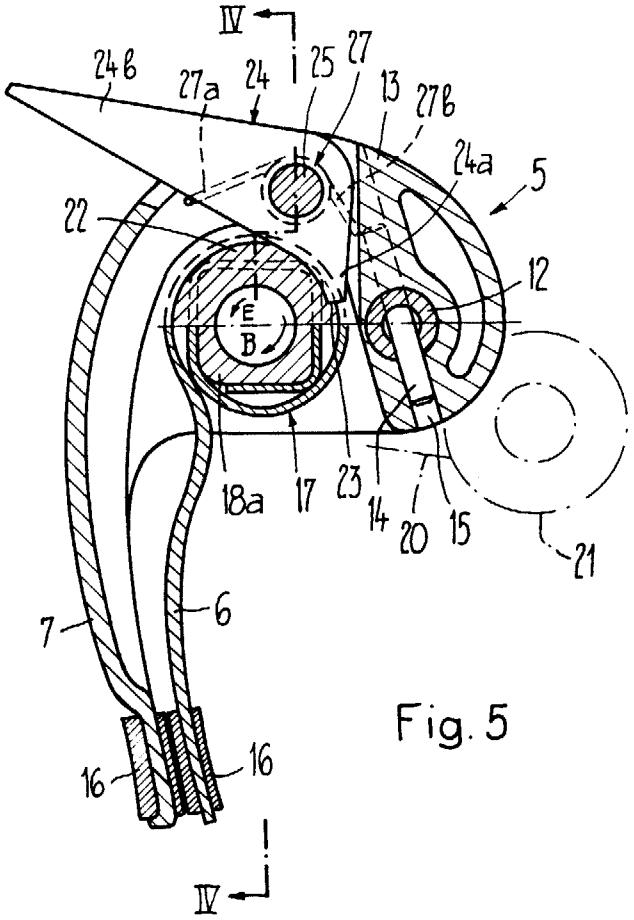
FIG. 5 is a sectional view taken substantially along the line V—V of FIG. 4.
Figure 4:
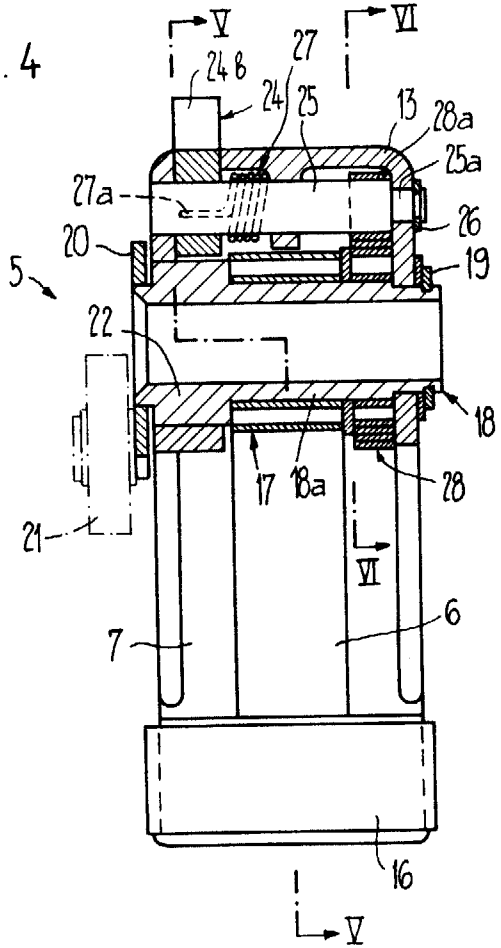
FIG. 4 is a sectional view taken substantially along the line IV—IV of FIG. 5.

Seated upon the hollow shaft 18 is a blocking wheel 22 of a pawl blocking arrangement, as shown in FIGS. 4 and 5. In the exemplary embodiment under discussion this blocking wheel 22 is constructed as part of the hollow shaft 18. As best seen by referring to FIG. 5, this blocking wheel 22 is provided with a gap 23 into which engages, in the latching position, the front end 24a of a blocking pawl 24. The other end 24b of the blocking pawl 24 protrudes past the housing 13. The blocking pawl 24 is rotatably seated upon an axle or shaft 25 which piercingly extends through the housing 13 and is retained therein. The one end 25a of the axle or shaft 25 is offset for this purpose and carries at the outer side of the housing 13 a securing ring 26 or the like, as shown particularly well in FIG. 4. Upon this axle or shaft 25 there is arranged a leg spring 27, whose one leg 27a engages at the blocking pawl 24 and whose other end or leg 27b is supported at the housing 13. By means of this leg spring 27 the blocking pawl 24 is pressed at its end 24a against the blocking wheel 22 and into the gap 23. As an equivalent structure to the gap 23 it is possible to provide at the blocking wheel 22 also a tooth at which engages the end 24a of the blocking pawl 24 in the latching position.

As will be seen by inspecting FIG. 4 and, in particular, FIG. 6, there is wound about the square portion or section 18a of the hollow shaft 18 a further spiral spring 28 which is connected at one end with the shaft 18 and at the other end 28a braces against the shaft or axle 25. This spiral spring 28 serves the purpose of retaining in an open condition the gripper clamps 5 during their movement from the delivery region to the transfer or take-over region. However, under circumstances it would be possible to dispense with the use of this spring 28.

At the delivery or outfeed region there is arranged an opening device for opening the gripper clamps 5. This opening device, as best seen by referring to FIG. 2, contains a control roller or roll 29 which can be raised and lowered in the direction of the double-headed arrow C, by means of a suitable actuation or displacement device, here shown as a pressurised cylinder unit 30. The control roller or roll 29 serves to rock the blocking pawl 24 in the direction of the arrow D, in order to thereby release the pawl blocking arrangement.

The mode of operation of the described conveyor device 1 will now be considered and is as follows:

As will be evident by inspecting FIG. 1, the gripper clamps 5 arrive in an opened condition at the transfer region. As already explained, there can be provided for the purpose of retaining open the clamp tongues or jaws 6,7 the spring 28. Yet it is also possible, as explained, to dispense with the use of this spring 28 and instead to provide a bracket or cam arrangement directly in front of the transfer region, which causes by means of the roller 21 travelling thereon a rocking or pivoting of the movable clamping tongue or jaw 6 into its open position. Between both of the clamping tongues 6 and 7 there now arrives the printed product 2 which is to be seized. With the illustrated exemplary embodiment the printed products 2 are engaged at the region of their open side 2b (the so-called cut side or flower). During the course of the further movement in the direction of the arrow A the roller 21 travels on to the bracket or cam 11. The latter then causes, by means of the action of the lever 21, rotation of the hollow shaft 18 in the direction of the arrow B shown in FIGS. 2, 5 and 6. Consequently, the movable clamping tongue 6 is moved towards the stationary clamping tongue 7, and the printed product 2 is fixedly retained between both of the clamping tongues 6 and 7. As soon as the clamping tongues 6 and 7, while pressing together the seized printed product 2, are brought together and a further pivoting of the movable clamping tongue 6 is no longer possible, then during the further rotation of the hollow shaft 18 the spiral spring 17 and also the spiral spring 28 are tensioned. This tensioning of the springs 17 and 28 or equivalent structure is terminated at that point in time when the end 24*a* of the blocking pawl 24 engages into the gap 23 of the blocking wheel 22. Due to the latching of the blocking pawl 24 into the gap 23 there is prevented any rotation back of the hollow shaft 18 by the action of the biased or tensioned springs 17 and 28. The spiral spring 17 now exerts a clamping force corresponding to its tension or bias upon the clamping tongue or jaw 6. Additionally, the spiral spring 17 serves as a holder or retention spring for the blocking mechanism 22, 23, 24 which is located in its latched position. Since the latching position is exactly defined by the position of the gap 23 and always remains the same, there is achieved the beneficial result that the tensioning of the spiral spring 17 with closed gripper clamp 5 and thus also the closing force exerted thereby at the clamping tongue 6 is greater when handling thick products than in the case of thin products. The thick products 2 which, as a general rule, are also heavier are therefore retained with a greater clamping force than the thin products. In this way it is possible to always faultlessly retain the printed products 2 independent of their thickness during their further transport.

Based upon the showing of FIG. 2 there now will be explained the outfeed or delivery of the printed products 2.

The control roller or roll 29 located in its lower position and shown in full lines presses upon the end 24*b* of the blocking pawl 24 which protrudes past the housing 13 and therefore causes a rocking or pivoting of the blocking pawl 24 in the direction of the arrow D. During this pivotal movement the leg spring 27 is tensioned. Due to this rocking of the blocking pawl 27 the blocking mechanism is unlocked, i.e. the end 24*a* of the blocking pawl 24 is raised out of the gap 23. The now relaxing spiral spring 17 causes rotation of the hollow shaft 18 together with the lever 20 and the roller 21 in the direction of the arrow E (FIGS. 2 and 5). Consequently, there is simultaneously moved into the open position illustrated in FIG. 2 the movable clamping tongue or jaw 6 out of its closed position, so that the seized printed product 2 is immediately released. Depending upon the magnitude of the tensioning or biasing of the spiral spring 17 the movable clamping tongue 6 is lifted way from the stationary clamping tongue 7 through a relatively large angle. Since, as already previously explained, this spring 17 is tensioned more intensely when handling thick products 2 than during the processing of thin products, the clamping tongue 6 therefore will lift-off of the clamping tongue 7 by a greater amount when processing thick products than thin products. Thus, there is realised a faultless opening operation for every product thickness.

Although the spiral spring 17, as already mentioned, exerts a threefold function, namely functions as a closing and opening spring for the clamping tongue or jaw 6 and as a holder or retention spring for the pawl blocking arrangement 22, 23, 24, the printed products are faultlessly retained and immediately released, and specifically, independent of their thickness.

By means of the opening device 29, 30 it is possible to open each of the gripper clamps 5 or only individual ones of such gripper clamps. As long as the control roller 29 is located in the lower end or terminal position, as previously described, there is then accomplished an opening of the gripper clamps 5. If, however, the control roller 29 is raised into the upper position shown in phantom or broken lines in FIG. 2, then the control roller 29 does not have any effect upon the blocking pawl 24. Consequently, there is not accomplished any opening of the gripper clamps 5.

It should be understood that there can be employed instead of the spiral spring 17 also a different constructed spring element which connects the lever 20 with the clamping tongue 6.

There has been disclosed as an example of a releasable latching device having a defined latching position a pawl blocking arrangement or device which can, however, have any other suitable construction from that herein disclosed and illustrated. Additionally, there also can be used a releasable latching device having another suitable construction.

While there are shown and described present preferred embodiments of the invention, it is to be distinctly understood that the invention is not limited thereto, but may be otherwise variously embodied and practiced within the scope of the following claims. Accordingly,

What I claim is:

1. An article conveyor apparatus, especially for printed products, comprising:

a revolvingly driven traction element;

a plurality of gripper clamps anchored in spaced relationship and supported by said revolvingly driven traction element;

each of said gripper clamps having a movable clamp portion and a further clamp portion coacting therewith;

a stationary control device provided for said gripper clamps;

actuation means coacting with the stationary control device for bringing the movable clamp portion into a closed position;

a releasable locking device for fixedly retaining the movable clamp portion in such closed position;

said locking device comprising a latching device having a defined latching position;

said latching device having a latchable element;

said actuation means being coupled with the latchable element of the latching device; and a spring element which is tensioned when the related gripper clamp is closed and which is operatively connected with the actuation means and with the movable clamp portion of such gripper clamp.

2. The conveyor apparatus as defined in claim 1, wherein:

said latching device comprises a blocking mechanism.

3. The conveyor apparatus as defined in claim 2, wherein:

said blocking mechanism contains a pawl blocking arrangement.

4. The conveyor apparatus as defined in claim 2, wherein:

said blocking mechanism contains a blocking pawl;

a blocking wheel defining said latchable element and having a blocking portion; and said blocking pawl being movable into a latching position where it coacts with the blocking portion of said blocking wheel.

5. The conveyor apparatus as defined in claim 4, wherein:

said blocking portion comprises a gap.

6. The conveyor apparatus as defined in claim 4, wherein:

said blocking portion comprises tooth means.

7. The conveyor apparatus as defined in claim 4, further including:

means for exerting a spring force for pressing the blocking pawl against the blocking wheel.

8. The conveyor apparatus as defined in claim 1, wherein:

said actuation means comprises a rotatably mounted shaft and an actuation element;

said latchable element of said latching device being arranged upon said rotatably mounted shaft; and said rotatably mounted shaft being rigidly connected for rotation with said actuation element.

9. The conveyor apparatus as defined in claim 8, wherein:

said spring element is connected with said shaft and said movable clamp portion and is tensioned upon closing of the gripper clamp.

10. The conveyor apparatus as defined in claim 9, wherein:

said spring element comprises a bending spring which, after bringing together the clamp portions, is tensioned in the latching position during further rotation of the shaft.

11. The conveyor apparatus as defined in claim 10, wherein:

said spring element comprises a spiral spring which extends about said shaft.

12. The conveyor apparatus as defined in claim 1, wherein:

said spring element is formed of one-piece with said movable clamp portion.

* * * * *